US010603932B2

(12) United States Patent
Aida

(10) Patent No.: US 10,603,932 B2
(45) Date of Patent: Mar. 31, 2020

(54) PRINTING APPARATUS AND CONTROL METHOD FOR PRINTING APPARATUS

(71) Applicant: SEIKO EPSON CORPORATION, Tokyo (JP)

(72) Inventor: Yohei Aida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/274,608

(22) Filed: Feb. 13, 2019

(65) Prior Publication Data

US 2019/0248164 A1 Aug. 15, 2019

(30) Foreign Application Priority Data

Feb. 15, 2018 (JP) ..... 2018-024801

(51) Int. Cl.

| | |
|---|---|
| ***B41J 15/04*** | (2006.01) |
| ***B41J 29/38*** | (2006.01) |
| ***B41J 11/00*** | (2006.01) |
| ***B41J 13/00*** | (2006.01) |
| ***B41J 11/42*** | (2006.01) |

(52) U.S. Cl.

CPC ..... *B41J 13/0027* (2013.01); *B41J 11/002* (2013.01); *B41J 11/008* (2013.01); *B41J 11/42* (2013.01); *B41J 29/38* (2013.01); *B41J 15/04* (2013.01)

(58) Field of Classification Search

CPC . B41J 29/38; B41J 11/42; B41J 11/008; B41J 13/0027; B41J 15/04

See application file for complete search history.

(56) References Cited

U.S. PATENT DOCUMENTS

2008/0084443 A1* 4/2008 Yasue ..... B41J 13/0009 347/16
2010/0110135 A1* 5/2010 Yoshida ..... B41J 11/425 347/16
2014/0199105 A1 7/2014 Tsukuda
2016/0243858 A1* 8/2016 Ogimura ..... B41J 13/0009

FOREIGN PATENT DOCUMENTS

JP 2014-133377 7/2014

* cited by examiner

*Primary Examiner* — Scott A Richmond
(74) *Attorney, Agent, or Firm* — Workman Nydegger

(57) ABSTRACT

Provided is a printer that includes a transport unit configured to transport a printing medium; a detection unit configured to detect a transport direction in which the printing medium is transported by the transport unit and a transport amount of the printing medium; and a control unit that makes the transport unit transport the printing medium after the printing of the first image, makes the detection unit detect the transport direction and the transport amount of the printing medium, determines a transport direction in which the printing medium is to be transported and a transport amount of the printing medium to be transported based on the detected transport direction and the detected transport amount, and makes the transport unit transport the printing medium based on the above determined transport direction and transport amount before printing a second image which is formed an image subsequent to the first image.

5 Claims, 10 Drawing Sheets

PRINTING APPARATUS AND CONTROL METHOD FOR PRINTING APPARATUS

BACKGROUND

1. Technical Field

The present invention relates to printing apparatuses and control methods for printing apparatuses.

2. Related Art

There has been such a case that one printed material is produced by printing, on a printing medium, images that are based on a plurality of pieces of image data. In this case, it is possible to print the images at uniform intervals by ignoring margin settings held by the respective pieces of image data (for example, see JP-A-2014-13377).

JP-A-2014-133377 discloses a printing apparatus that is provided with a file storage region in which input data containing margin-setting information is stored as files, and a continuous printing unit configured to select files among the files stored in the file storage region and print the selected files continuously on a tape in the order of selection. This printing apparatus performs printing in such a manner that, among the plurality of files, the length of a margin between files that are printed adjacent to each other takes a predetermined length regardless of the margin-setting information.

When a plurality of images is printed on a printing medium, there is a case in which a printed image needs to be checked after some images have been printed. At this time, in a case where a user moves the printing medium by manual operation in order to check the printed image, an interval between the images becomes irregular when the printing is restarted, thereby wasting the printing resources in some case. For example, in a case where a plurality of images is printed on roll paper so as to be delivered as one printed material such as an advertising medium, when the intervals between the images do not match the intervals expected by the user, the printed material may not be delivered in some cases because of its undesirable appearance.

SUMMARY

An advantage of some aspects of the invention is to appropriately adjust intervals between images based on a plurality of pieces of image data, even in a case where operation to transport a printing medium is carried out.

An aspect of the invention includes: a transport unit configured to transport a printing medium; a printing unit configured to print, on the printing medium, a first image based on first image data; a detection unit configured to detect a transport direction in which the printing medium is transported by the transport unit and a transport amount of the printing medium transported by the transport unit; an operation unit configured to accept an operation for making the transport unit transport the printing medium; and a control unit that makes the detection unit detect a transport direction in which the transport unit has transported the printing medium and a transport amount of the printing medium having been transported by the transport unit in response to an operation accepted by the operation unit after the printing of the first image, and determines, before printing a second image based on second image data which is data for forming an image subsequent to the first image, whether or not it is necessary to transport the printing medium by the transport unit based on the detected transport direction and the detected transport amount.

According to this configuration, even if the printing medium has been transported by the operation accepted with the operation unit after the printing of the first image, it is possible to detect the transport direction in which the printing medium has been transported and the transport amount of the transported printing medium, and thus it is possible to determine whether or not it is necessary to transport the printing medium by the transport unit based on the detected transport direction and the detected transport amount. Because of this, it is possible to adjust an interval between the first image and the second image to be printed on the printing medium to a desirable one.

It is preferable that, in a case where the control unit determines it necessary to transport the printing medium by the transport unit based on the detected transport direction and the detected transport amount, the control unit determine a transport direction and a transport amount for the transport unit in such a manner that the interval between the first image and the second image to be printed on the printing medium becomes equal to a preset distance.

According to this configuration, it is possible to print the images based on a plurality of pieces of image data at a preset interval.

It is preferable that, in a case where the control unit determines it unnecessary to transport the printing medium by the transport unit based on the detected transport direction and the detected transport amount, the control unit cause the printing unit to start the printing of the second image based on the second image data without causing the transport unit to transport the printing medium.

According to this configuration, the interval between the first image and the second image to be printed on the printing medium can be allowed to be the same as the interval at which the printing medium has been transported by the operation accepted by the operation unit. Accordingly, it is possible to set the interval between the first image and the second image by manual operation.

It is preferable that a display unit be further provided, and that the control unit cause a first distance corresponding to the transport amount of the printing medium detected by the detection unit and a preset second distance to be displayed in the display unit, and determine whether or not it is necessary to transport the printing medium by the transport unit depending on an operation accepted by the operation unit.

According to this configuration, it is possible for a user to select either the first distance or the second distance as the interval between the first image and the second image to be printed on the printing medium.

Another aspect of the invention includes: printing, when a printing medium is transported by a transport unit, a first image based on first image data on the printing medium; accepting an operation, by an operation unit, for making the transport unit transport the printing medium after the printing of the first image; detecting, after the printing of the first image, a transport direction in which the transport unit has transported the printing medium and a transport amount of the printing medium having been transported by the transport unit in response to the accepted operation; and determining, before printing a second image based on second image data which is data for forming an image subsequent to the first image, whether or not it is necessary to transport the printing medium by the transport unit based on the detected transport direction and the detected transport amount.

According to this configuration, even if the printing medium has been transported by the operation accepted with the operation unit after the printing of the first image, it is possible to detect the transport direction in which the printing medium has been transported and the transport amount of the printing medium, and thus it is possible to determine whether or not it is necessary to transport the printing medium by the transport unit based on the detected transport direction and the detected transport amount. Because of this, it is possible to adjust an interval between the first image and the second image to be printed on the printing medium to a desirable one.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings.

Figure 1:
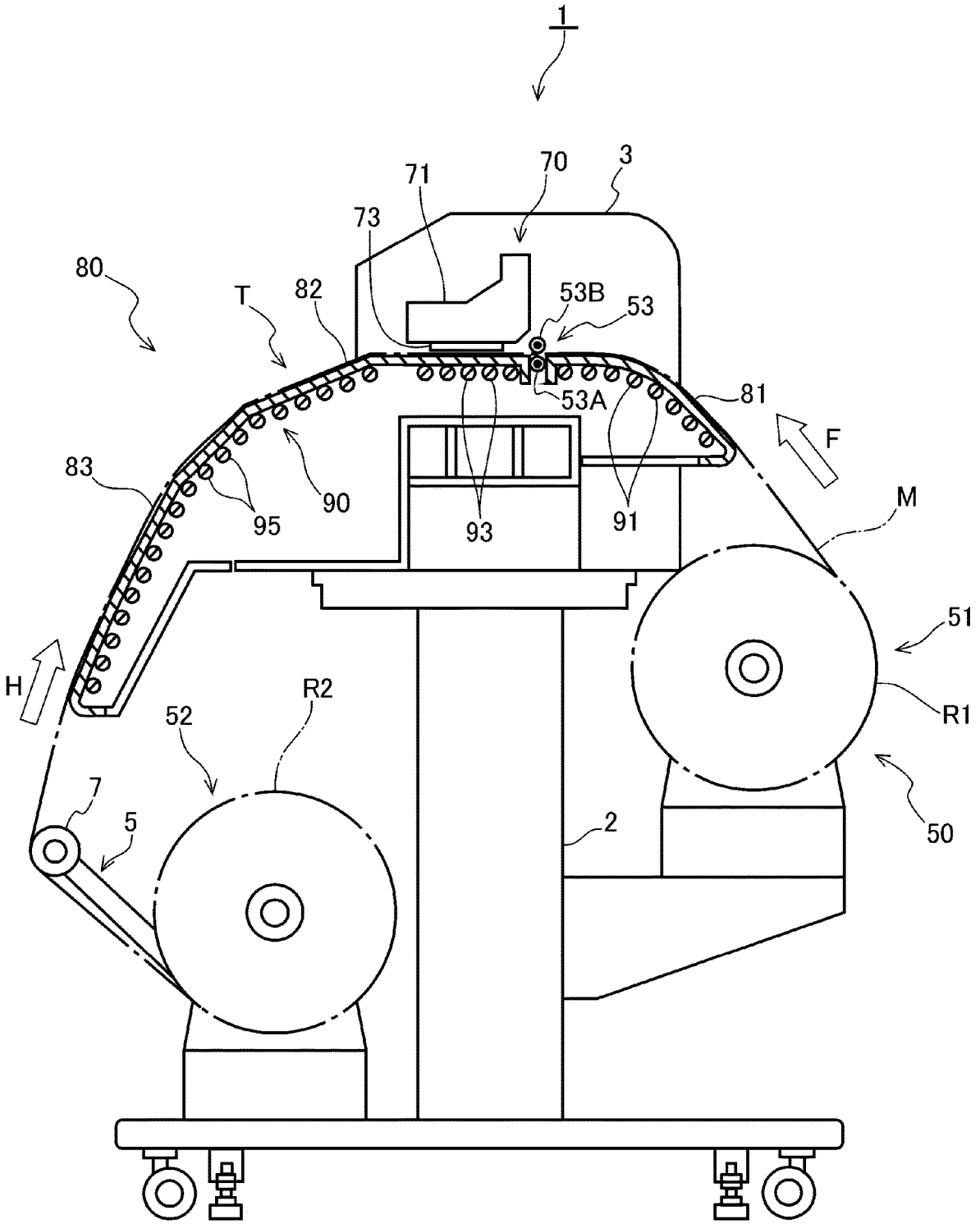
FIG. 1 is a configuration diagram illustrating a major portion of a printer.

FIG. 1 is a configuration diagram illustrating a major portion of a printer 1. The printer 1 corresponds to a "printing apparatus" of the invention. The printer 1 is an apparatus configured to print characters, images, and the like by ejecting ink in an ink jet scheme onto a printing medium M. In the present embodiment, a case in which the printer 1 is a large format printer (LFP) configured to print images on a relatively large size printing medium M is exemplified and explained.

As illustrated in FIG. 1, the printer 1 includes a pedestal 2 with a plurality of casters attached on a lower end thereof, and a main body 3 formed in a substantially rectangular parallelepiped shape and supported on the pedestal 2.

The printer 1 includes a transport unit 50 configured to transport the printing medium M in a roll-to-roll scheme. The transport unit 50 includes a feeding section 51, a sending section 53, and a winding section 55.

The feeding section 51 feeds out the printing medium M from a roll body R1 where the long printing medium M is wound in a roll form.

The sending section 53 causes the printing medium M, fed out by the feeding section 51, to be transported along a transport path T formed with an upper surface of a support member 80 (explained later). The sending section 53 includes a drive roller 53A and a slave roller 53B. The sending section 53 transports the printing medium M in a state of being pinched between the drive roller 53A and the slave roller 53B, on the transport path T between the feeding section 51 and the winding section 55.

The winding section 55 winds the printing medium M, which was fed out by the feeding section 51 and on which printing has been performed, on a roll body R2.

The printer 1 includes a printing unit 70 configured to print characters, images, and the like by ejecting ink onto the printing medium M. The printing unit 70 includes a carriage 71 on which a print head 73 is mounted at a position opposing the printing medium M. The print head 73 is mounted on the carriage 71 in such a manner that an opening of a nozzle through which ink is ejected opposes the printing medium M.

The support member 80 is provided between the feeding section 51 and the winding section 55 to support the printing medium M in such a manner that the printing medium M is bent and projected upward. A plurality of members having a predetermined shape, which is formed by bending plate members made of sheet metal or the like, is attached, thereby constituting the support member 80.

The support member 80 includes a sending support portion 81, a print support portion 82, and a discharge support portion 83. The sending support portion 81 supports the printing medium M having been fed out from the roll body R1 on the upstream side of the transport path T relative to the printing unit 70. The print support portion 82 is provided at a position opposing the printing unit 70 and supports a portion of the printing medium M to serve as a print region. The discharge support portion 83 supports the printing medium M after printing on the downstream side of the transport path T relative to the printing unit 70. The sending support portion 81, the print support portion 82, and the discharge support portion 83 are disposed in a state of being continuously connected substantially flush with each other.

On a rear side of the support member 80, there is provided a heater 90 to heat the printing medium M. The heater 90 includes a preheater 91, a platen heater 93, and an after-heater 95. The preheater 91 is disposed on a rear side of the sending support portion 81 and preheats the printing medium M at the rear side of the sending support portion 81. The platen heater 93 is disposed on a rear side of the print support portion 82 and heats the printing medium M. The after-heater 95 is disposed on a rear side of the discharge support portion 83 and heats the printing medium M to dry the ink. The heater 90 configured as described above heats the printing medium M using the preheater 91, the platen heater 93, and the after-heater 95 so as to quickly dry and fix the ink to the printing medium M, thereby making it possible to prevent bleeding, blurring, or the like and enhance the print quality.

At a position under an end portion on the downstream side of the discharge support portion 83, there is provided a tensile-force application mechanism 5 configured to apply tensile force to the printing medium M. The tensile-force application mechanism 5 includes a tension roller 7, which makes contact with the printing medium M to apply pressure thereto, between the discharge support portion 83 and the winding section 55. The tension roller 7 is rotatably supported at a leading end portion of a pair of arm members whose base ends are rotatably supported with respect to the pedestal 2, and has a long axis length in a width direction (a direction orthogonal to the paper surface of FIG. 1) of the printing medium M. The printing medium M is wound on the roll body R2 on the downstream side of the discharge support portion 83 in a state in which the tension in proportion to the weight of the tension roller 7 is being applied to the printing medium M.

Next, a functional configuration of the printer 1 will be described.

Figure 2:
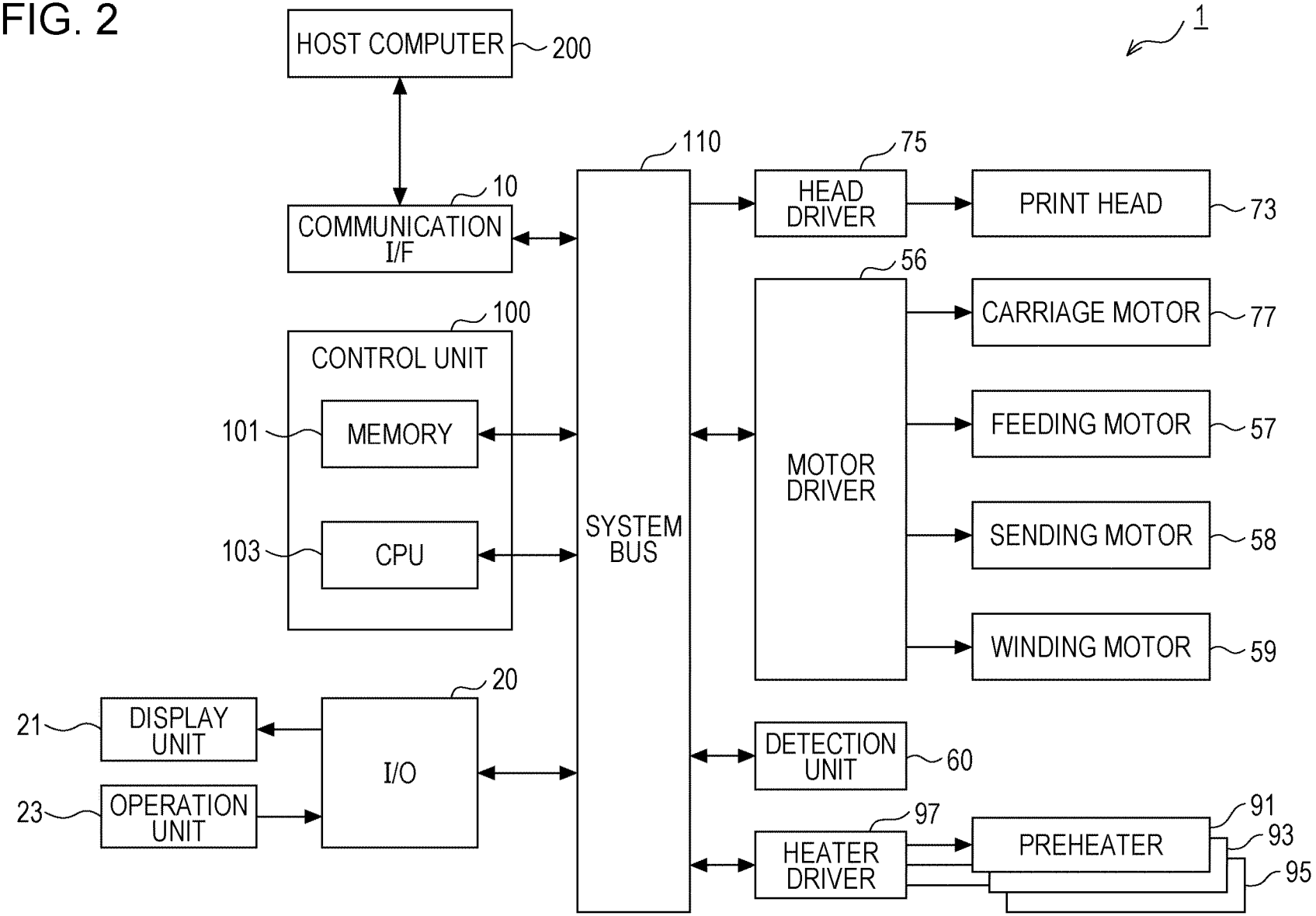
FIG. 2 is a diagram illustrating a functional configuration of a printer.

FIG. 2 is a diagram illustrating the functional configuration of the printer 1. The printer 1 has a configuration in which a communication I/F 10, an input/output unit (denoted as "I/O") 20, a head driver 75, a motor driver 56, a detection unit 60, a heater driver 97, and a control unit 100 are communicably connected to one another via a system bus 110.

The communication I/F 10 performs data communication with a host computer 200 in conformity with predetermined communication standards. The host computer 200 is, for example, a computer apparatus such as a personal computer that is configured to transmit, to the printer 1, image data to be printed by the printer 1.

A display unit 21 and an operation unit 23 are connected to the I/O 20. The display unit 21 is a display device such as a liquid crystal display (LCD). The operation unit 23 is an input device that is configured to accept operations and is provided with a button, a switch, and the like. For example, a sending button, a return button, and the like are provided in the operation unit 23. The sending button is a button to allow the printing medium M to be transported in a first direction F (see FIG. 1). The return button is a button to allow the printing medium M to be transported in a second direction H (see FIG. 1), which is an opposite direction to the first direction F. The first direction F is a direction in which the printing medium M is fed out from the roll body R1 to be wound on the roll body R2. The second direction H is a direction in which the printing medium M having been wound on the roll body R2 is fed out from the roll body R2 to be wound on the roll body R1.

The operation unit may make the transport unit 50 transport the printing medium M not based on the operation of the button, switch, and the like connected to the I/O 20, but based on the operation of a mechanism such as a knob mounted on the transport unit 50.

The print head 73 is connected to the head driver 75. The head driver 75 drives the print head 73 based on print data inputted from the control unit 100.

The motor driver 56 is connected to a carriage motor 77, a feeding motor 57, a sending motor 58, and a winding motor 59. The motor driver 56 drives the motors under the control of the control unit 100.

The carriage motor 77 is a motor for moving the carriage 71 in the width direction of the printing medium M.

The feeding motor 57 is a motor for rotating the roll body R1. By the feeding motor 57 being driven, the roll body R1 is rotated so that the printing medium M is fed out from the roll body R1.

The sending motor 58 is a motor for rotating the drive roller 53A. When the drive roller 53A is rotated by the driving of the sending motor 58, the printing medium M pinched between the drive roller 53A and the slave roller 53B is transported on the transport path T.

The winding motor 59 is a motor for rotating the roll body R2. By the winding motor 59 being driven, the roll body R2 is rotated so that the printing medium M is wound on the roll body R2.

Note that the feeding motor 57, the sending motor 58, and the winding motor 59 are motors capable of performing normal rotation and reverse rotation. In the case where the feeding motor 57, the sending motor 58, and the winding motor 59 are normally rotated, the printing medium M is transported in the first direction F. In the case where the feeding motor 57, the sending motor 58, and the winding motor 59 are reversely rotated, the printing medium M is transported in the second direction H.

Figure 3:
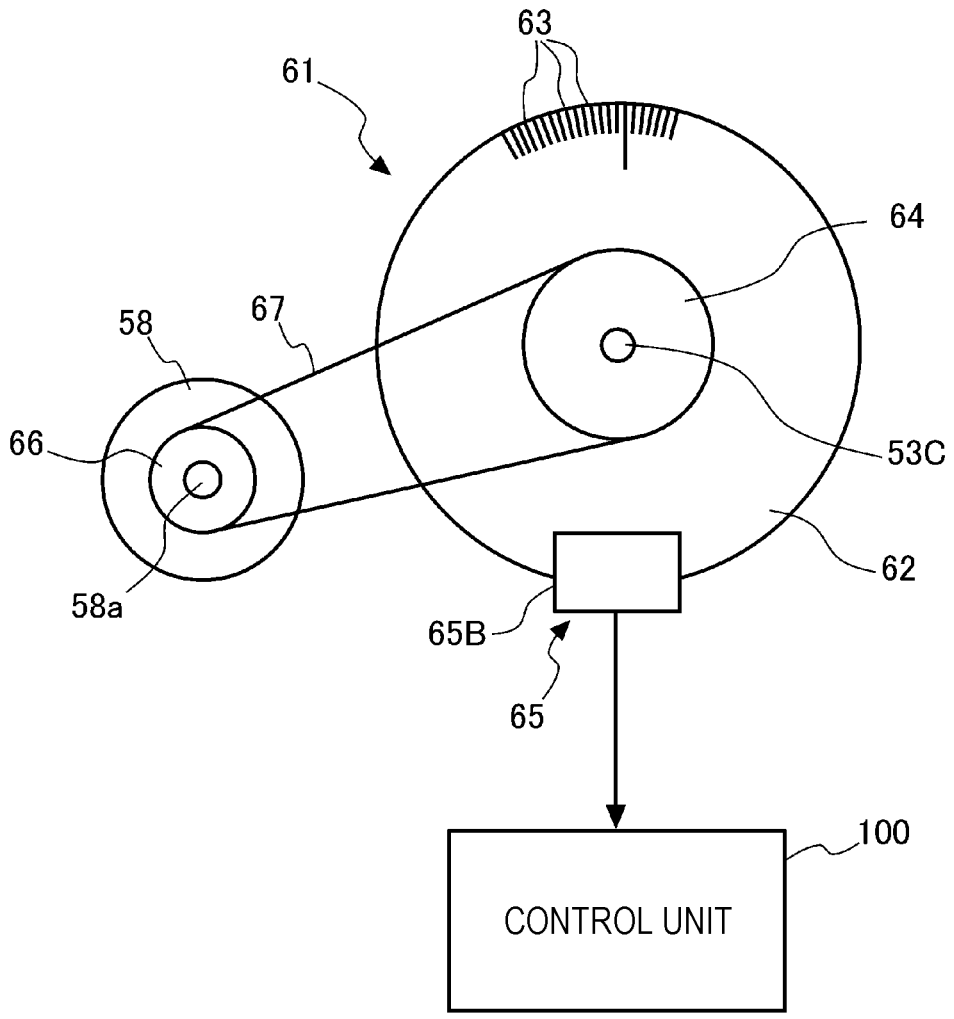
FIG. 3 is a diagram illustrating a configuration of a sending section and a detection unit.

FIG. 3 is a diagram illustrating a configuration of the sending section 53 and the detection unit 60.

A slave pulley 64 is fixed to a rotation axis 53C of the drive roller 53A of the sending section 53. Further, a drive pulley 66 is fixed to a drive axis 58*a* of the sending motor 58. A timing belt 67 in an endless form is wound on the drive pulley 66 and the slave pulley 64. Turning force of the sending motor 58 is transferred to the drive roller 53A by the timing belt 67, so that the drive roller 53A is rotated.

The detection unit 60 includes a rotary encoder 61. The rotary encoder 61 includes a slit disk 62 fixed to the rotation axis 53C of the drive roller 53A, and a position detector 65 provided on a circumferential edge of the slit disk 62. A plurality of slits for position detection 63 is formed along the whole circumferential edge of the slit disk 62 at equal intervals (FIG. 3 illustrates only part of the slits). The position detector 65 includes a light emitting element formed of a light emitting diode (not illustrated) and a light receiving element 65B formed of a phototransistor in such a manner that these elements oppose each other across the circumferential edge of the slit disk 62. When light from the light emitting element passes through the slits for position detection 63 of the slit disk 62 and is received by the light receiving element 65B, pulses are outputted from the light receiving element 65B.

The control unit 100 detects a rotational position of the drive roller 53A by counting the number of pulses outputted from the light receiving element 65B of the rotary encoder 61. In addition, the control unit 100 counts the number of pulses so as to detect a change amount in rotational position of the drive roller 53A and detect an amount of rotation of the sending motor 58.

The heater driver 97 drives the preheater 91, the platen heater 93, and the after-heater 95. The heater driver 97 drives the preheater 91, the platen heater 93, and the after-heater 95 under the control of the control unit 100, so as to heat the printing medium M.

The control unit 100 includes a memory 101 and a CPU 103.

The memory 101 is a memory device such as a ROM and a RAM. The memory 101 stores a control program, a preset set data, and the like. The set data includes, for example, the count of pulses outputted by the detection unit 60, information of a preset constant distance, and the like. The count is the number of pulses outputted by the detection unit 60 in the case where the printing medium M is transported by the preset constant distance. The information of the preset constant distance is information indicating an interval between images to be printed on the printing medium M. In addition, the memory 101 is used as a working area when the CPU 103 performs computational operation. The CPU 103 executes the control program to control constituent elements of the printer 1. Although the CPU 103 is indicated as a processor in FIG. 2, the number of processors is not limited to one, and a plurality of CPUs (or semiconductor chips) may be provided in the configuration. Further, a co-processor such as an Application Specific Integrated Circuit (ASIC) or a System-on-a-Chip (SoC) may be mounted in the control unit 100.

The control unit 100 controls the motor driver 56 to drive the feeding motor 57, the sending motor 58, the winding motor 59, and the like, thereby making the printing medium M be transported on the transport path T. The control unit 100 controls the heater driver 97 to make the heater 90 heat the printing medium M transported on the transport path T. When the communication I/F 10 has received image data, the control unit 100 converts the received image data to print data (dot data). The control unit 100 outputs the converted print data to the head driver 75, and makes ink droplets be ejected through nozzles corresponding to the dot data of the print data.

When, after the printing of the image based on the print data being ended, subsequent image data is received by the communication I/F 10, the control unit 100 makes the printing medium M be transported in the first direction F by the preset constant interval (constant distance) in accordance with the set data. Thereafter, the control unit 100 makes the image printing be restarted. To be specific, the control unit 100 controls the motor driver 56 to drive the feeding motor 57, the sending motor 58, the winding motor 59, and the like, thereby making the printing medium M be transported in the first direction F. At this time, the control unit 100 counts the number of pulses inputted from the detection unit 60, and makes the motor driver 56 stop the driving of the feeding motor 57, the sending motor 58, the winding motor 59, and the like when the counted number of pulses becomes equal to the preset count. Thereafter, the control unit 100 causes the image, which is based on the print data found by converting the received image data, to be printed on the printing medium M. With these operations, images based on a plurality of pieces of image data are printed on the printing medium M being separated from each other by the preset constant distance as the constant interval.

Further, the control unit 100 determines whether or not the operation of the sending button or the operation of the return button (hereinafter, collectively referred to as "button operation") has been accepted after the image having been printed. When the button operation has been accepted, the control unit 100 makes the printing medium M be transported in the first direction F or the second direction H in accordance with the accepted button operation. At this time, during a period in which an operation signal corresponding to the operation of the sending button or the return button is inputted from the operation unit 23, the control unit 100 controls the motor driver 56 to make the printing medium M be transported in the first direction F or the second direction H. In other words, while the user is pressing the sending or return button, the printing medium M is transported in the first direction F or the second direction H.

While the printing medium M being transported by the transport unit 50 in response to the operation of the sending or return button having been accepted, the control unit 100 counts the number of pulses outputted from the detection unit 60 and calculates a transport amount (transport distance) of the printing medium M based on the counted number of pulses. The control unit 100, when being received image data, causes a message inquiring an interval of the image to be printed, to be displayed in the display unit 21. Here, the "interval of the image" refers to an interval between the image having already been printed and the image to be printed at the current time based on the received image data. In the case where the printing medium M is transported by the operation of the sending or return button, even if the printing medium M is transported by the preset constant distance, the interval of the image does not become equal to the constant interval. As such, the control unit 100 causes a message inquiring whether the image printing should be restarted from a position after the transport by the operation of the sending or return button, or should be restarted at the preset constant interval to be displayed in the display unit 21.

In the case where the control unit 100 accepts the operation indicating that the printing is to be restarted from the position after the transport by the operation of the sending or return button, the control unit 100 makes the image printing be restarted without transporting the printing medium M by the transport unit 50.

Meanwhile, in the case where the control unit 100 accepts the operation indicating that the image printing is to be restarted at the preset constant interval, the control unit 100 finds a difference between the transport distance by the operation of the sending or return button and the preset constant distance. The control unit 100 calculates, based on the found difference in distance, an amount of rotation of the drive roller 53A, and drives the motor driver 56 so that the amount of rotation of the drive roller 53A becomes equal to the calculated amount of rotation.

Figure 4:
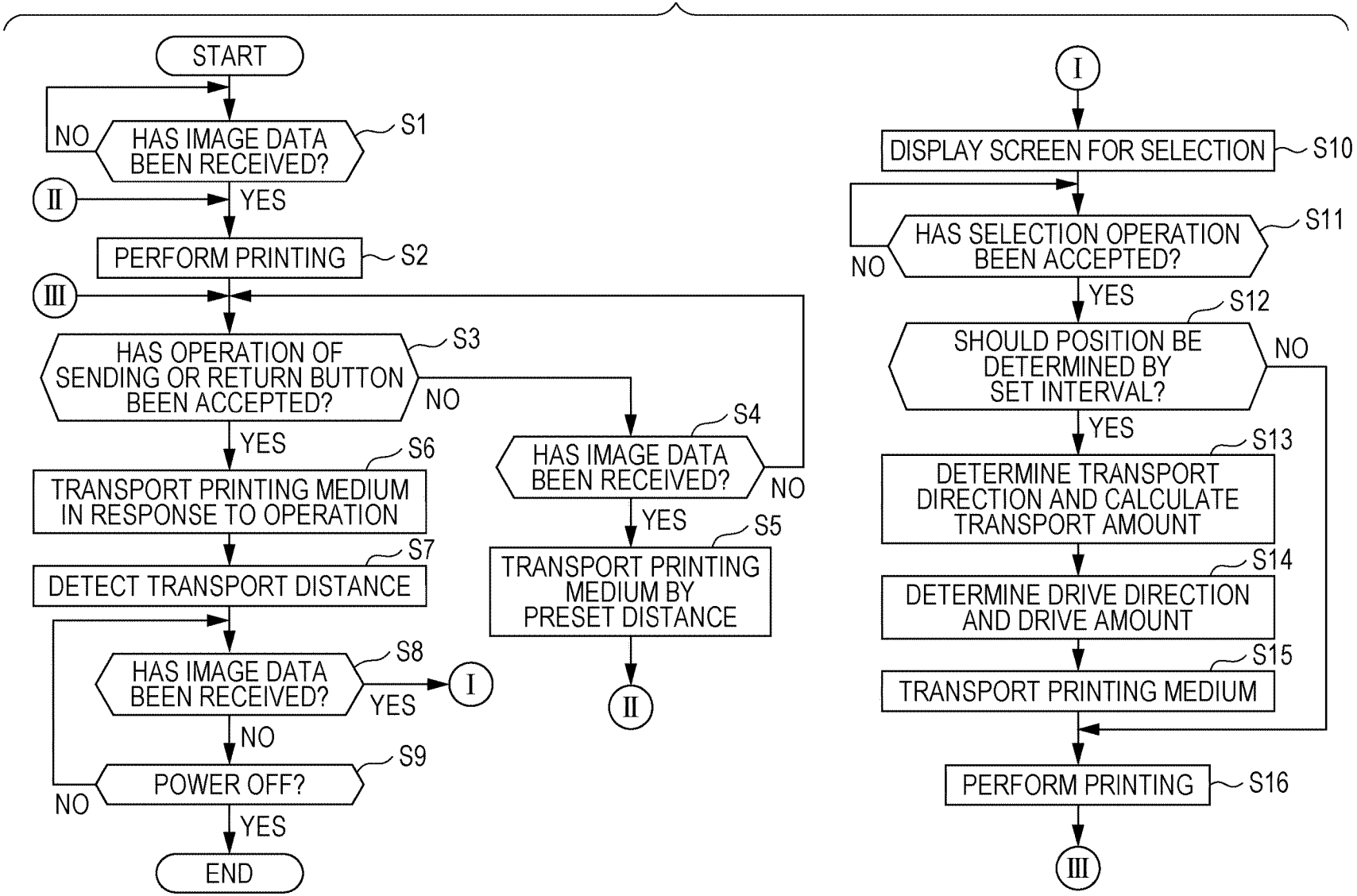
FIG. 4 is a flowchart illustrating operations of a control unit.

FIG. 4 is a flowchart illustrating operations of the control unit 100.

First, the control unit 100 determines whether or not image data has been received (step S1). In a case where the image data has not been received yet (step S1/NO), the control unit 100 is in a standby mode waiting for the start of the process until the reception of the image data.

In a case where the image data has been received (step S1/YES), the control unit 100 converts the received image data to print data, outputs the converted print data to the printing unit 70, and then makes the printing unit 70 perform printing (step S2). The printing unit 70 prints, on the printing medium M, an image based on the inputted print data. The image printed in step S2 corresponds to a "first image based on first image data" of the invention.

Figure 5:
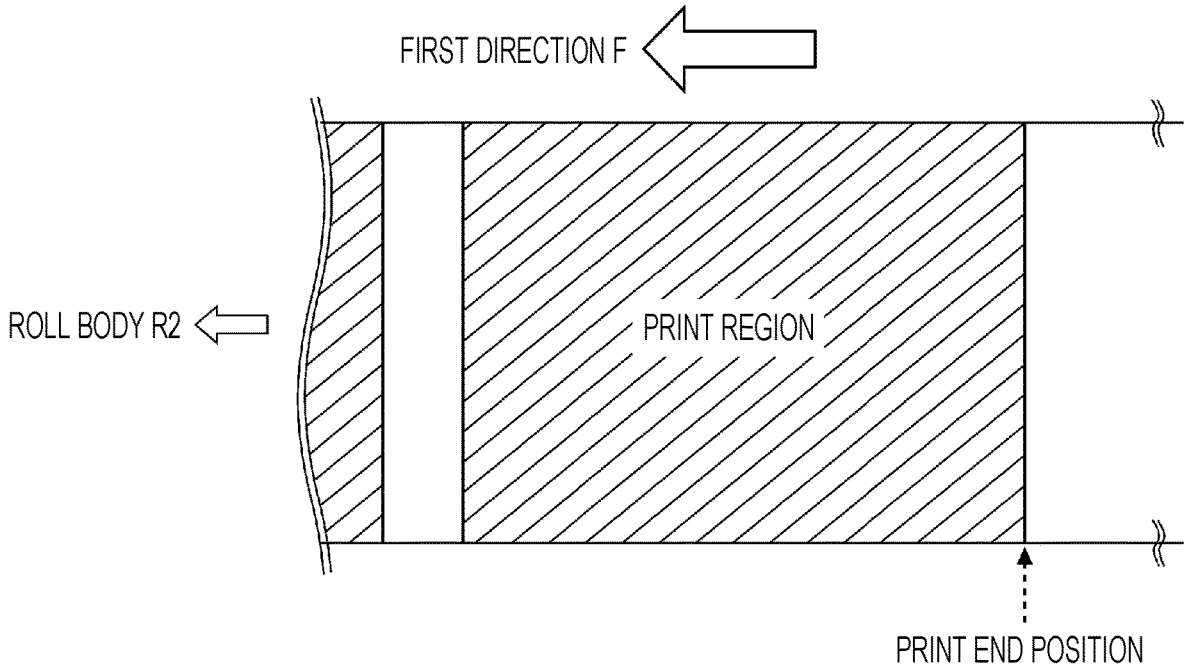
FIG. 5 is a diagram illustrating a printing medium on which an image based on print data has been printed.

FIG. 5 is a diagram illustrating the printing medium M on which printed is the image that is based on the image data received in step S1. A region of the printing medium M indicated by hatching in FIG. 5 is a print region in which the image based on the print data is printed. The image data received in step S1 corresponds to the "first image data" of the invention.

When the printing of the print data received in step S1 is ended, the control unit 100 determines whether or not the operation of the sending or return button has been accepted (step S3). The control unit 100 determines whether or not an operation signal corresponding to the operation of the sending or return button has been inputted from the operation unit 23. In a case where the operation signal corresponding to the operation of the sending or return button has not been inputted yet (step S3/NO), the control unit 100 determines whether or not image data has been received (step S4).

In a case where the image data has not been received yet (step S4/NO), the control unit 100 goes back to step S3 and determines whether or not the operation signal corresponding to the operation of the sending or return button has been inputted from the operation unit 23. In a case where the image data has been received (step S4/YES), the control unit 100 controls the motor driver 56 to make the printing medium M be transported by the preset constant distance (step S5). To be specific, the control unit 100 counts the number of pulses inputted from the detection unit 60, and drives the feeding motor 57, the sending motor 58, and the winding motor 59 by the motor driver 56 until the above count becomes equal to the count stored in the memory 101. This makes the printing medium M be transported by the preset constant distance. When the printing medium M is transported by the preset constant distance, the control unit 100 converts the image data received in step S4 to print data and makes the printing unit 70 print an image based on the converted image data.

Figure 6:
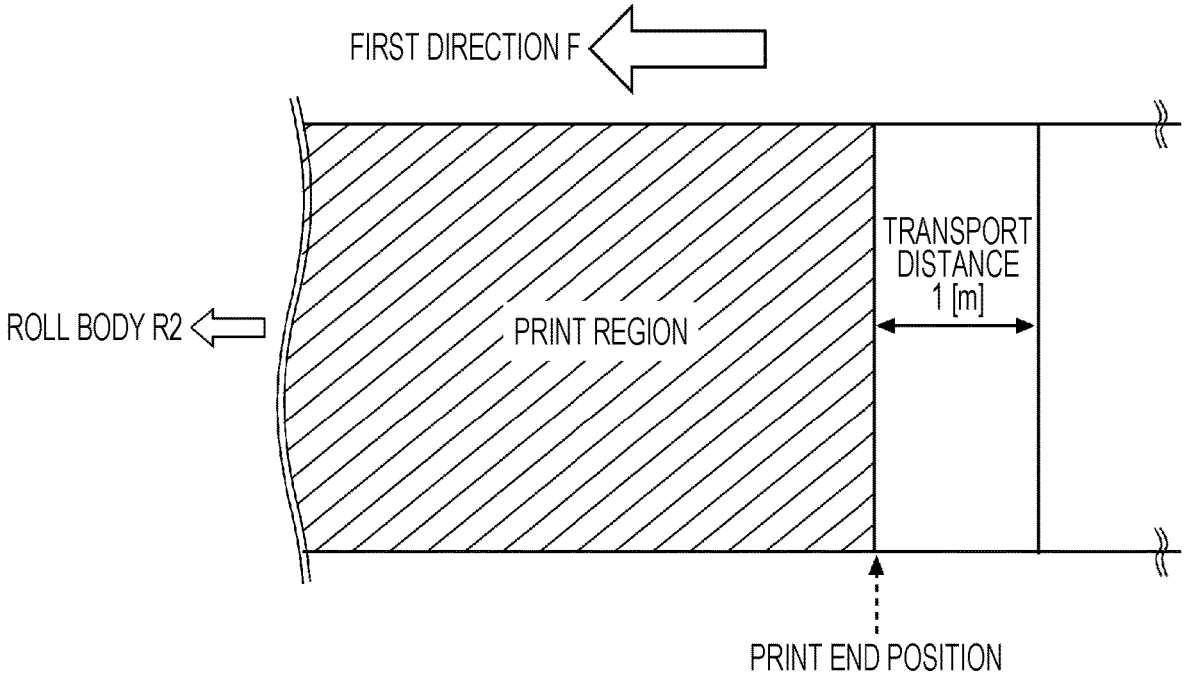
FIG. 6 is a diagram illustrating a printing medium after being transported by operation of a sending button.

In a case where the operation signal corresponding to the operation of the sending button or return button is inputted from the operation unit 23 (step S3/YES), the control unit 100 controls the motor driver 56 to make the printing medium M be transported while the operation signal being inputted continuously (step S6). In a case where the operation signal corresponding to the sending button is inputted, the control unit 100 makes the printing medium M be transported in the first direction F. Meanwhile, in a case where the operation signal corresponding to the return button is inputted, the control unit 100 makes the printing medium M be transported in the second direction H. FIG. 6 is a diagram illustrating the printing medium M after being transported by the operation of the sending button. FIG. 6 illustrates a state in which the printing medium M is transported by 1 m as the transport distance, after the printing performed in step S2 is ended.

While the control unit 100 is controlling the motor driver 56 to make the printing medium M be transported, the control unit 100 counts the number of pulses inputted from the detection unit 60. The control unit 100 finds a transport distance by which the printing medium M has been transported, based on the counted number of pulses (step S7).

Next, the control unit 100 determines whether or not image data has been received (step S8). In a case where the image data has not been received yet (step S8/NO), the control unit 100 determines whether or not the operation unit 23 has accepted an operation to turn off the power of the printer 1 (step S9). In a case where the operation to turn off the power of the printer 1 has been accepted (step S9/YES), the control unit 100 ends the current process flow. Meanwhile, in a case where the operation to turn off the power of the printer 1 has not been accepted yet (step S9/NO), the control unit 100 goes back to step S8 and determines whether or not the image data has been received (step S8).

In a case where the image data has been received (step S8/YES), the control unit 100 causes a screen for selection to be displayed in the display unit 21 (step S10). The image data received in step S8 corresponds to "second image data" of the invention.

Figure 7:
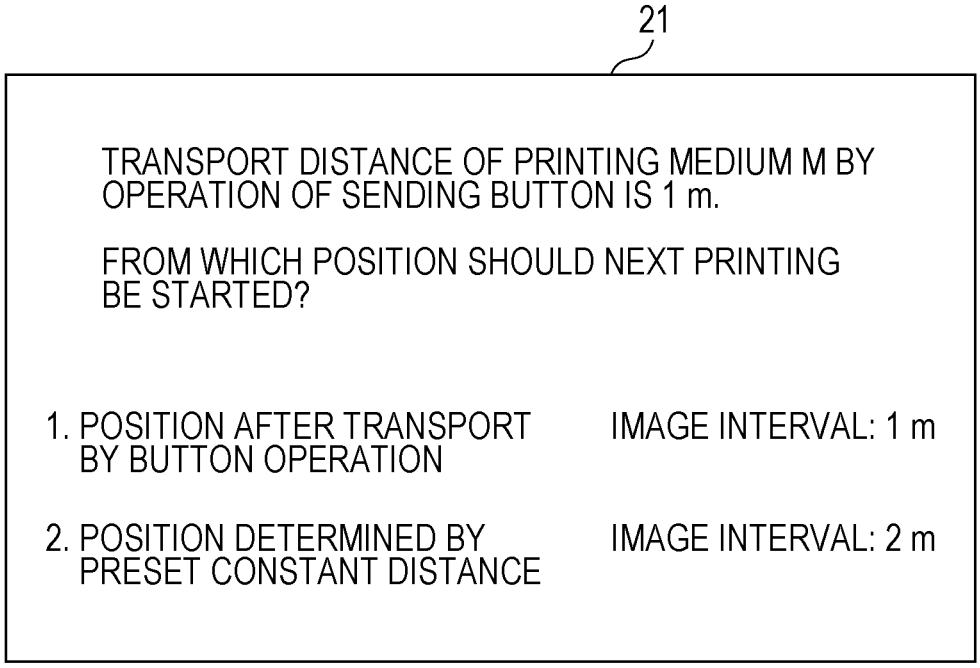
FIG. 7 is a diagram illustrating a screen for selection.

FIG. 7 is a diagram illustrating the screen for selection.

In the screen for selection, the transport distance of the printing medium M detected in step S7 is displayed. Further, in the screen for selection, displayed is a message inquiring whether the printing should be restarted from a position after the transport by the button operation in step S3, or should be restarted from a position determined by the preset constant distance. In this message display, indicated are the interval of the image (corresponds to a first distance of the invention) in a case of the position after the transport by the button operation in step S3 being selected, and the interval of the image (corresponds to a second distance of the invention) in a case of the preset constant distance being selected. A user operates the operation unit 23 and selects one of the positions determined by the two distances, from which the image printing is restarted.

In a case where the operation to select the position from which the printing is to be restarted has not been accepted yet (step S11/NO), the control unit 100 is in a standby mode waiting for the start of the process until the above operation is accepted (step S11). Meanwhile, in a case where the operation to select the position from which the printing is to be restarted has been accepted (step S11/YES), the control unit 100 determines whether or not the selected position is the position after the transport by the button operation (step S12).

In a case where it is determined that the selected position is not the position after the transport by the button operation (step S12/YES), the control unit 100 determines that the position determined by the preset constant distance is selected as the position for restarting the printing. In this case, the control unit 100 finds a transport direction in which the printing medium M is to be transported and a transport distance thereof (step S13). To be specific, the control unit 100 determines the transport direction and the transport distance of the printing medium M based on the transport distance having been detected in step S7 and the preset constant distance. For example, in a case where the transport distance having been detected in step S7 is 1 m and the preset constant distance is 2 m, the control unit 100 determines the transport direction to be the first direction F and determines the transport distance to be 1 m. In a case where the transport distance having been detected in step S7 is 3 m and the constant distance is 2 m, the control unit 100 determines the transport direction to be the second direction H and determines the transport distance to be 1 m.

When the transport direction and the transport distance are determined, the control unit 100 specifies a rotational direction of the drive roller 53A and calculates the amount of rotation thereof based on the determined transport direction and transport distance (step S14). Then, the control unit 100 drives the motor driver 56 so that the feeding motor 57, the sending motor 58, and the winding motor 59 are driven. At this time, the control unit 100 allows the printing medium M to be transported by the transport distance in the transport direction until the amount of rotation of the drive roller 53A becomes equal to the calculated amount of rotation (step S15).

Figure 8:
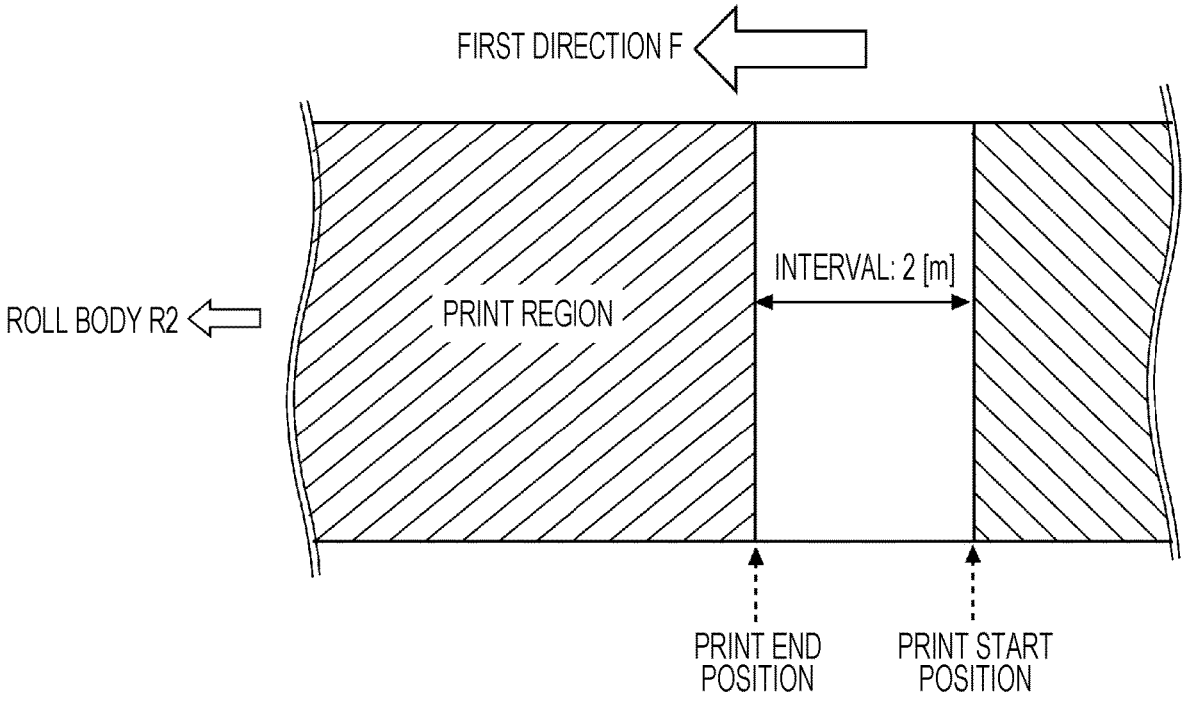
FIG. 8 is a diagram illustrating a printing medium.

When the printing medium M has been transported by the transport distance in the transport direction (step S15), the control unit 100 make the printing unit 70 print an image based on the print data having been received in step S8 (step S16). FIG. 8 is a diagram illustrating the printing medium M. In particular, FIG. 8 illustrates the printing medium M in a case in which, after the transport of the printing medium M by the preset constant distance (2 m), the image based on the image data having been received in step S8 is printed thereon. In this case, the printing is performed in such a manner that the interval between the image based on the image data having been received in step S1 and the image based on the image data having been received in step S8 is 2 m, which is equal to the preset constant distance.

Figure 9:
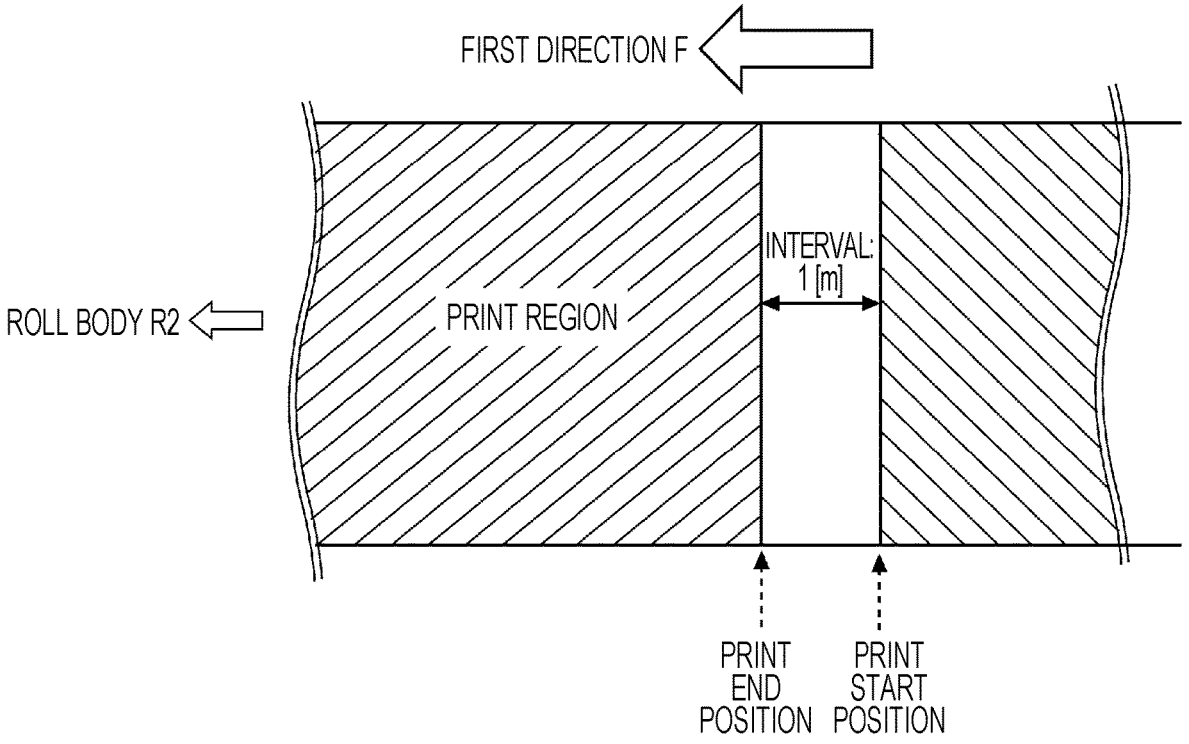
FIG. 9 is a diagram illustrating a printing medium.

Meanwhile, in a case where the position after the transport by the operation of the sending button is selected as the position for starting the printing (step S12/NO), the control unit 100 makes the printing unit 70 print the image based on the print data having been received in step S8 without transporting the printing medium M (step S16). The image printed in step S16 corresponds to a "second image based on the second image data" of the invention. FIG. 9 is a diagram illustrating the printing medium M. In particular, FIG. 9 illustrates the printing medium M in a case in which the image printing is restarted from the position after the transport by the button operation in step S3. In this case, the printing is performed in such a manner that the interval between the image based on the image data having been received in step S1 and the image based on the image data having been received in step S8 is 1 m.

Figure 10:
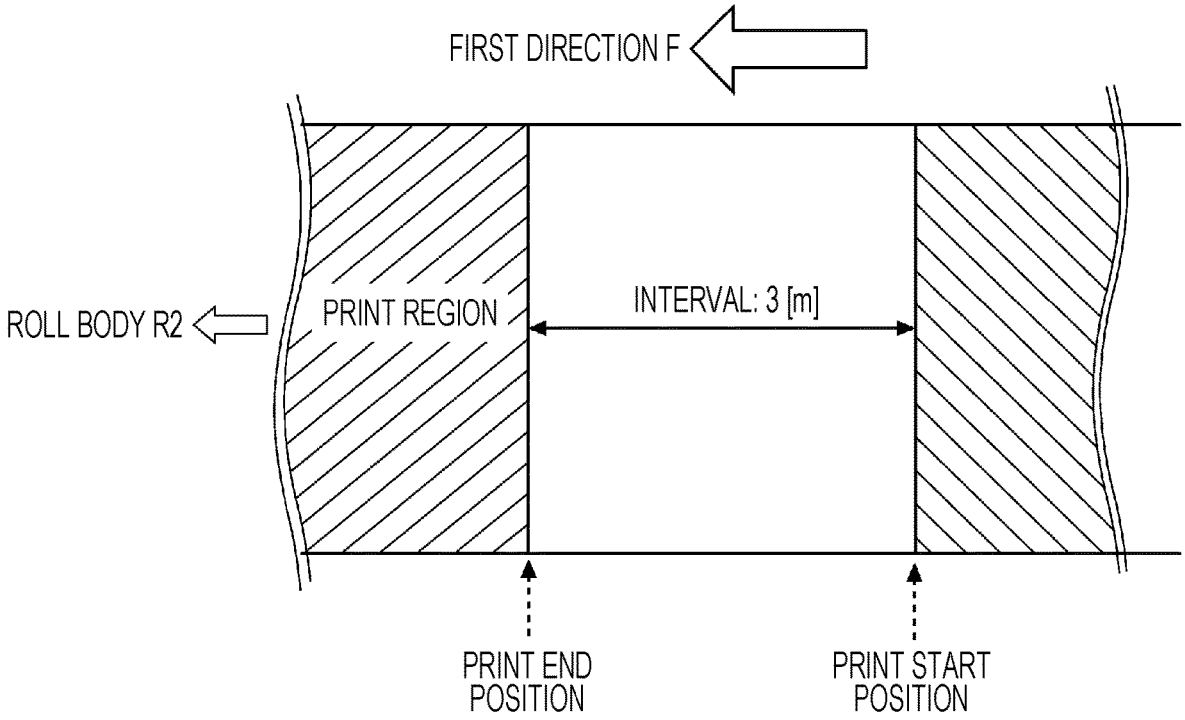
FIG. 10 is a diagram illustrating a printing medium on which printing has been performed by an existing printer.

FIG. 10 is a diagram illustrating a printing medium M on which an image has been printed by an existing printer.

In the case of the existing printer, when the printing medium M is transported by operation of a user after image printing, the printing medium M is further transported by a preset constant distance from a position after the transport by the user operation. For example, assume that the user has transported the printing medium M by 1 m by the operation of the operation unit in order to check the printed image. Further, assume that, in order for the interval of the image to take a constant distance, the transport distance by which the existing printer transports the printing medium M before printing is set to 2 m. In this case, a distance of 1 m as the transport distance by the operation of the operation unit and a distance of 2 m as the preset constant distance are added, and as a result, the printing medium M is transported by 3 m. Due to this, in the case where the image is printed by the existing printer, the interval of the image does not become equal to 2 m, which is the preset constant distance.

In contrast, in the present embodiment, the control unit 100 calculates a transport distance brought by the operation of the operation unit 23 and finds a transport distance to make the interval of the image equal to the preset constant distance when the preset constant distance is selected as the interval of the image. Then, the control unit 100 controls the motor driver 56 to make the printing medium M be transported by the above-found transport distance. This makes it possible to set the interval of the image to the preset constant distance even if the printing medium M is transported by the operation of the operation unit 23.

In the above-described embodiment, the screen for selection in which indicated is a message inquiring whether the printing should be restarted from a position after the transport by the button operation or should be restarted from a position determined by the preset constant distance, is displayed in the display unit 21. In addition to this, the control unit 100 may be configured such that, in the case where the printing medium M is transported by the button operation, the image may always be printed at the preset constant distance without displaying the screen for selection.

Further, the control unit 100 may determine whether or not it is necessary to transport the printing medium M by the transport unit 50, based on the found transport direction and transport distance of the printing medium M.

For example, even in the case where a user has caused the printing medium M to be transported by the operation of the sending button, the control unit 100 may determine it unnecessary to transport the printing medium M when the user performs an operation to return the printing medium M to the original position by the operation of the return button. In addition, in a case where the image is set to be formed not at a constant distance, but at an interval that falls within a preset constant range, the control unit 100 may determine whether or not the transport distance of the printing medium M falls within the constant range, and may determine it unnecessary to transport the printing medium M when the transport distance falls within the constant range.

As discussed thus far, the printer 1 of the present embodiment includes the transport unit 50, the printing unit 70, the detection unit 60, the operation unit 23, and the control unit 100.

The transport unit 50 transports the printing medium M.

The printing unit 70 prints, on the printing medium M, an image based on image data.

The control unit 100 and the detection unit 60 serving as a detection unit detect a transport direction in which the printing medium M is transported by the transport unit 50 and a transport amount thereof.

The control unit 100 makes the detection unit 60 detect a transport direction in which the transport unit 50 has transported the printing medium M and a transport amount of the printing medium M having been transported by the transport unit 50 in response to the operation accepted by the operation unit 23 after the printing of the first image. Before printing the second image based on the second image data as the data for forming an image subsequent to the first image, the control unit 100 determines, based on the detected transport direction and transport amount, whether or not it is necessary to transport the printing medium M by the transport unit 50.

According to this configuration, even if the printing medium M has been transported by the operation of the operation unit 23 after the printing of the first image, it is possible to detect the transport direction in which the printing medium M has been transported and the transport amount thereof, and thus it is possible to determine whether or not it is necessary to transport the printing medium M by the transport unit 50. Because of this, it is possible to adjust the interval between images to be printed on the printing medium M to a desirable one.

In the case where the control unit 100 determines it necessary to transport the printing medium M by the transport unit 50, the control unit 100 determines a transport direction and a transport amount for the transport unit 50 in such a manner that the interval between the first image and the second image to be printed on the printing medium M becomes equal to the preset distance.

According to this configuration, it is possible to print images based on a plurality of pieces of image data at the preset interval.

In the case where the control unit 100 determines it unnecessary to transport the printing unit M by the transport unit 50, the control unit 100 makes the printing unit 70 start the printing of the second image based on the second image data without making the transport unit 50 transport the printing medium M.

Accordingly, it is possible to set the interval between the first image and the second image by manual operation.

The printer 1 includes the display unit 21.

The control unit 100 causes the first distance corresponding to the transport distance of the printing medium M detected by the detection unit 60 and the preset second distance, to be displayed in the display unit 21. In the case where any one of the first distance and the second distance is selected by the operation accepted by the operation unit 23, the control unit 100 determines a drive direction and a drive amount for the transport unit 50 based on the selected first or second distance.

Accordingly, it is possible to select either the first distance or the second distance as the interval between the first image and the second image to be printed on the printing medium M.

The above-described embodiment is a preferred embodiment of the invention. Note that, however, the invention is not limited thereto, and various kinds of variations can be made within a range not departing from the spirit of the invention.

For example, in the above-discussed embodiment, the case in which the print data printed by the printer 1 is print data received from the host computer 200 is exemplified and explained. The print data may be data stored in the memory 101 beforehand, or data read from a USB memory, an SD card or the like.

Functional units of the printer 1 illustrated in FIG. 2 represent functional configurations, and therefore their specific mounting modes are not limiting in particular. In other words, it is not absolutely necessary that pieces of hardware corresponding to individual functional units are mounted, and it is needless to say that a configuration in which functions of the plurality of functional units are implemented by a single processor executing a program can be achieved. Note that in the above embodiment, part of the functions implemented by software may be implemented by hardware, and part of the functions implemented by hardware may be implemented by software.

Respective processing units in the flowchart illustrated in FIG. 4 are given by dividing the process carried out by the control unit 100 in accordance with major processing contents, in order to facilitate the understanding of the process carried out by the control unit 100. The manner in which the processing units are divided as illustrated in the flowchart in FIG. 4, the names, and the like are not intended to limit the invention. The process carried out by the control unit 100 can be divided into more processing units in number according to the processing contents, and can also be divided in such a manner that a single processing unit includes more pieces of processing. In addition, also the order of processing in the flowchart is not limited to the example illustrated in the drawing.

In a case where the control method for the printing apparatus according to the aspect of the invention is implemented by using a computer, the invention can also be configured in a mode including a program executed by the computer to implement the control method, a recording medium in which the program is stored in a readable manner by the computer, or a transmission medium for transmitting the program. As the above-mentioned recording medium, a magnetic or optical recording medium, or a semiconductor memory device can be used. Specifically, the following portable or stationary recording media can be cited: a flexible disk, a Hard Disk Drive (HDD), a Compact Disk Read Only Memory (CD-ROM), a Digital Versatile Disk (DVD), a Blu-ray (registered trademark) Disk, a magneto-optical disk, a flash memory, card type recording medium, and the like. Further, the above-mentioned recording medium may be a Random Access Memory (RAM) or a Read Only Memory (ROM) which is an internal storage unit provided in an image display device, or a non-volatile storage unit such as a HDD.

This application claims priority to Japanese Application No. 2018-024801, filed 15 Feb. 2018, the entirety of which is incorporated by reference herein

What is claimed is:

1. A printing apparatus comprising:

a transport unit configured to transport a printing medium;

a printing unit configured to print, on the printing medium, a first image based on first image data;

a detection unit configured to detect a transport direction in which the printing medium is transported by the transport unit and a transport amount of the printing medium transported by the transport unit;

an operation unit configured to accept an operation for making the transport unit transport the printing medium; and a control unit that makes the detection unit detect a transport direction in which the transport unit has transported the printing medium and a transport amount of the printing medium having been transported by the transport unit in response to an operation accepted by the operation unit after printing of the first image, and determines, before printing a second image based on second image data which is data for forming an image subsequent to the first image, whether or not it is necessary to transport the printing medium by the transport unit based on the detected transport direction and the detected transport amount.

2. The printing apparatus according to claim 1, wherein, in a case where the control unit determines it necessary to transport the printing medium by the transport unit based on the detected transport direction and the detected transport amount, the control unit determines a transport direction and a transport amount for the transport unit in such a manner that an interval between the first image and the second image to be printed on the printing medium becomes equal to a preset distance.

3. The printing apparatus according to claim 1, wherein, in a case where the control unit determines it unnecessary to transport the printing medium by the transport unit based on the detected transport direction and the detected transport amount, the control unit causes the printing unit to start the printing of the second image based on the second image data without causing the transport unit to transport the printing medium.

4. The printing apparatus according to claim 1, further comprising a display unit, wherein the control unit causes a first distance corresponding to the transport amount of the printing medium detected by the detection unit and a preset second distance to be displayed in the display unit, and determines whether or not it is necessary to transport the printing medium by the transport unit depending on an operation accepted by the operation unit.

5. A control method for a printing apparatus, the method comprising:

printing in which a printing medium is transported by a transport unit, and a first image based on first image data is printed on the printing medium;

accepting an operation, by an operation unit, for making the transport unit transport the printing medium after the printing of the first image;

detecting, after the printing of the first image, a transport direction in which the transport unit has transported the printing medium and a transport amount of the printing medium having been transported by the transport unit in response to the accepted operation; and determining, before printing a second image based on second image data which is data for forming an image subsequent to the first image, whether or not it is necessary to transport the printing medium by the transport unit based on the detected transport direction and the detected transport amount.

* * * * *